US005249998A

United States Patent [19]

Woolley et al.

[11] Patent Number: 5,249,998

[45] Date of Patent: * Oct. 5, 1993

[54] WATER SPORTS DEVICE

[76] Inventors: Robert C. Woolley, 27941 Matterhorn, Lake Arrowhead, Calif. 92352; Michael J. Murphy, 33124 Case St., Elsinore, Calif. 92330

[ * ] Notice: The portion of the term of this patent subsequent to Mar. 31, 2009 has been disclaimed.

[21] Appl. No.: 778,395

[22] Filed: Oct. 16, 1991

Related U.S. Application Data

[63] Continuation of Ser. No. 496,790, Mar. 21, 1990, Pat. No. 5,100,354.

[51] Int. Cl.[5] ..... B63B 35/81

[52] U.S. Cl. ..... 441/65; 114/274; 114/253; 441/72

[58] Field of Search ..... 441/65, 68, 72, 79; 114/253, 274, 275, 276, 277, 278, 279, 280, 281, 282, 283

[56] References Cited

U.S. PATENT DOCUMENTS

| | | | |
|---|---|---|---|
| D. 265,116 | 6/1982 | Churchill . | |
| 2,751,612 | 6/1956 | Shepard . | |
| 2,930,338 | 3/1960 | Flomenhoft . | |
| 2,931,332 | 4/1960 | Hebrank . | |
| 3,003,778 | 10/1961 | Taggart . | |
| 3,026,546 | 3/1962 | Kakes . | |
| 3,092,857 | 6/1963 | Churchman . | |
| 3,092,858 | 6/1963 | Wallach . | |
| 3,105,249 | 10/1963 | Palmore . | |
| 3,121,890 | 2/1964 | Rumsey, Jr. . | |
| 3,123,844 | 3/1964 | Bailey . | |
| 3,145,399 | 8/1964 | Jackson . | |
| 3,164,119 | 1/1965 | Emmanuel et al. . | |
| 3,182,341 | 5/1965 | Rieffle . | |
| 3,201,807 | 8/1965 | Weaver . | |
| 3,208,422 | 9/1965 | Schopmeyer . | |
| 3,216,031 | 11/1965 | Ingold, Jr. . | |
| 3,455,264 | 7/1969 | Castellani . | |
| 3,604,031 | 9/1971 | Cahill . | |
| 3,688,723 | 9/1972 | Ulvesand et al. . | |
| 3,744,811 | 7/1973 | Johnston . | |
| 3,747,138 | 7/1973 | Morgan . | |
| 3,803,653 | 4/1974 | Trostad . | |
| 3,996,868 | 12/1976 | Schagen . | |
| 4,028,761 | 6/1977 | Taylor . | |
| 4,361,103 | 11/1982 | Willat . | |
| 4,508,046 | 4/1985 | Coulter et al. . | |
| 4,593,926 | 6/1986 | Pergola . | |
| 4,669,992 | 6/1987 | Morris | 441/65 |
| 4,720,280 | 1/1988 | Hufnagl et al. . | |
| 4,857,025 | 8/1989 | Brown et al. | 441/65 |
| 4,857,026 | 8/1989 | Hull . | |
| 5,100,354 | 3/1992 | Wooley et al. | 441/65 |

FOREIGN PATENT DOCUMENTS

| | | |
|---|---|---|
| 426487 | 6/1913 | France . |
| 1295926 | 5/1962 | France . |

*Primary Examiner*—Michael S. Huppert
*Assistant Examiner*—Thomas J. Brahan
*Attorney, Agent, or Firm*—Knobbe, Martens, Olson & Bear

[57] ABSTRACT

A water sports device for supporting a seated human rider while the rider and the device are towed behind a powered water craft,, including an elongate board to which a seat and foot holder are secured, an elongate arm extending downward from the board and a planing blade secured to the arm generally parallel to the board so that the planing blade provides essentially no lift when the board is horizontal. The positioning of the seat and the planing blades at the rear of the board, the use of a single vertical strut, the size of the planing blade and the positioning of the foot holders at least two feet in front of the seat provides a water sports device which is relatively easy to ride,, while at the same time being highly maneuverable and capable of high jumps.

14 Claims, 5 Drawing Sheets 24
98
55
59
23
121
53
21
61
13
15
27
25
19
17
27
11
29
37
35
39
31
33
41

45°
4
4
3
3
55
23
53
13
15
17
25
27
28
110
125
37
33
31
39
35
41
59
11
61
29
131
44
45
48

WATER SPORTS DEVICE

This application is a continuation of application Ser. No. 07/496,790 filed Mar. 21, 1990, now U.S. Pat. No. 5,100,354, issued Mar. 31, 1992.

BACKGROUND OF THE INVENTION

This invention relates to water sports devices generally and in particular, to water sports devices incorporating multiple planing surfaces.

For years, efforts have been made to develop a water sports device which would rival the popularity of traditional water skis, Water skiing is popular because although the sport is relatively easy to learn, high speed maneuvering and jumping are challenging and exciting even for the experienced skier. Traditional water skis are, of course, not without their drawbacks. Specifically, skiing for more than a short duration can require a great deal of leg and lower back strength. Furthermore, skiing puts a great deal of stress on the rider's legs, particularly the knees, all too often resulting in injury.

Numerous attempts have been made to develop a desirable alternative to traditional water skiing by incorporating hydrofoils on skis, knee boards and water sleds. A hydrofoil is a blade attached to the bottom of a craft at a small angle to the horizontal so that when the craft is in notion, the fluid striking each blade's underside creates a high pressure region below the blade, low pressure above its, resulting in lift that raises the craft out of the water, thereby reducing drag at high speeds. Unfortunately, each of these efforts has suffered from a number of serious drawbacks.

For example, U.S. Pat. No. 2,751,612 teaches the attachment of a hydrofoil device to each ski of the user. A pair of channel members are adapted to be adjustably secured along the sides of the water ski by a pair of nuts and bolts from which depend downwardly extending, inwardly inclined front and rear struts secured to an oval-shaped member between which is supported a hydrofoil unit. Unfortunately, experience has shown this device to be virtually impossible to ride in that the hydrofoil unit provides too narrow base for the rider to balance upon.

Another hydrofoil and ski arrangement is disclosed by U.S. Pat. No. 3,164,119. This reference teaches a single V-shaped hydrofoil lift having upwardly diverging legs, the upper ends of which are provided with inwardly extending horizontal limbs to which skis may be attached. The lower convergent ends of the logs are secured by means of welding or bolts to a horizontally disposed boon having an axis extending forwardly and rearwardly of the planar legs and perpendicular thereto. Foils are attached to the boom forwardly and rearwardly of the strut and transversely of the boom, the forward foil being attached to the upper side of the boom and allegedly having a positive lifting effect and the rearward foil being attached to the underside of the boon and allegedly having a negative lifting effect.

Unfortunately, riding this hydrofoil ski arrangement is extremely difficult. The hydrofoil arrangement requires high speed and the lift of the V-shaped converging legs of the strut to lift the rider from the water. Unfortunately, even when the tow boat is moving at a constant speed, if the rider attempts to maneuver the skis, the effective speed of the hydrofoil skis through the water changes, thereby raising or lifting the skis.

The change in lift resulting from the change in the proportion of the V-shaped strut in the water is difficult for the rider to adjust to. In addition, as the lenticular shape of the strut is drawn through the water, the resistance of the water causes vortices, making it extremely difficult for most skiers to maintain control of the skis. Furthermore, the extremely thin lifting and stabilizing bars cause extreme front and rear instability, resulting in rapid rises and descents. Specifically, it is extremely difficult and tiring for the rider to maintain his or her ankles in a 90° locked position to maintain the hydrofoil at a constant height.

This is likewise true of the kneeboard arrangement disclosed by the same reference. The kneeboard incorporates two depending vertical struts from which is secured a boom extending roughly the length of the kneeboard. As in the case of the ski arrangement, foils are attached forwardly and rearwardly of the struts, the forward foil being attached to the upper side of the boom and having a positive lifting effect and the rearward boom being attached to the underside of the boon and having a negative lifting effect. In addition to the aforementioned vertical instability. As is true of kneeboards in general, the board is difficult to maneuver. Likewise, as with kneeboards in general, kneeling soon proves to be an uncomfortable position, particularly if the board jumps from the water.

Another approach is taught by U.S. Pat. No. 3,105,249, which teaches a hydrofoil apparatus built somewhat like a bicycle or steerable sled. The reference teaches the use of a front and rear hydrofoil structure, each of which is secured to a vertical member. Each vertical member in turn is connected to the other by a horizontal bar. The rear hydrofoil assembly is fixedly secured to the horizontal member and a seat is mounted on the horizontal member proximate the junction between the horizontal member and the vertical member. The front vertical member is mounted in such a manner as to be pivotable relative to the horizontal member, and a pair of handle bars is secured to the vertical member to enable the rider to control this pivot action. The front hydrofoil structure is generally triangular with an upper horizontal member and two converging lower members. The rear hydrofoil structure comprises a trapezoidal structure resembling a truncated triangle, having parallel upper and lower horizontal members and two converging connecting members. The apparatus is towed by means of a tow rope secured to the bottom of the front hydrofoil structure. The reference teaches that as the apparatus moves through the water, the reaction between the hydrofoils and the water causes the apparatus to rise until only the lower portion of the converging foils are below the surface of the water.

As with the other hydrofoil apparatuses, this device is unstable, particularly at high speeds, due to the tendency of the hydrofoils to shoot out of the water. Likewise, as with other triangular hydrofoil structures, the converging lenticular shape of the vertical legs cause extreme vortices when turning, making it difficult to control the device. Finally, as is apparent from the configuration of the device, riding the apparatus is very dangerous, in that, in the event of a fall, the rider is likely to be thrown against the horizontal connecting bar or the handle bars of the device.

Accordingly, there is needed an improved water sports device which requires only a moderate level of skill to ride while offering the excitement of maneuvering and jumping for the more advanced rider. Desirably, the water sports device should provide these attributes without requiring the physical endurance demanded by traditional water skis and without exerting high levels of stress on the legs of the rider.

SUMMARY OF THE INVENTION

The present invention is a water sports device for supporting a seated human rider while the rider and the device are towed behind a powered water craft. The device includes an elongate board having a front end and a back end to which is secured a seat for supporting the buttocks of the rider in a position spaced from and roughly centered above the back one-third of the board. A holder for securing at least one foot of the rider over the top of the board is secured to the board spaced at least two feet toward the front end of the board from the seat. An elongate arm extends downward from the board. A planing blade is secured to the arm spaced from the board, so as to be generally parallel to the board so that the planing blade provides essentially no lift when the board is horizontal. Desirably the water sports device is provided with a seat belt for securing the buttocks of the rider to the seat to protect the rider from being struck by the device in the event of a fall.

Another aspect of the present invention in a water sports device for supporting a seated human rider while the rider and the device are towed behind a powered water craft. The device includes an elongate board having a front end and a back end, and a seat secured to the board for supporting the buttocks of a seated rider above the board. The holder is spaced toward the front end of the board from the seat for securing at least one foot of the rider over the top of the board. An elongate strut extends downward from and perpendicular to the board. A support having a forward end and a rearward end is fixed to the strut at a position below the board. The forward planing blade is secured proximate the forward end of the support, generally parallel to the board, and the rear planing blade is secured proximate the rearward end of the support, generally parallel to the board so that the forward planing blade and the rearward planing blade provide essentially no lift when the board is horizontal. The rear planing blade is positioned below the board at least as far back as the back one-quarter of the board. The forward planing blade and rearward planing blade preferably has a combined lower surface area of at least one-hundred (100) square inches.

Another aspect of the present invention is a water sports device for supporting a seated human rider while the rider and the device are towed behind a powered water craft, wherein the device includes an elongate board which supports a seat and a holder for securing at least one foot of the rider over the top of the board. A single strut extends downward and perpendicular to the board. An elongate support is fixed to the strut below the bottom of the board. A forward planing blade is secured proximate the forward end of the support, generally parallel to the board. A rear planing blade is secured proximate the rearward end of the support, generally parallel to the board. The rear planing blade is positioned below the board at least an far back as the back one-quarter of the board. The forward planing blade and the rearward planing blade provide essentially no lift when the board is horizontal.

DETAILED DESCRIPTION OF THE PREFERRED EMBODIMENT

Figure 1:
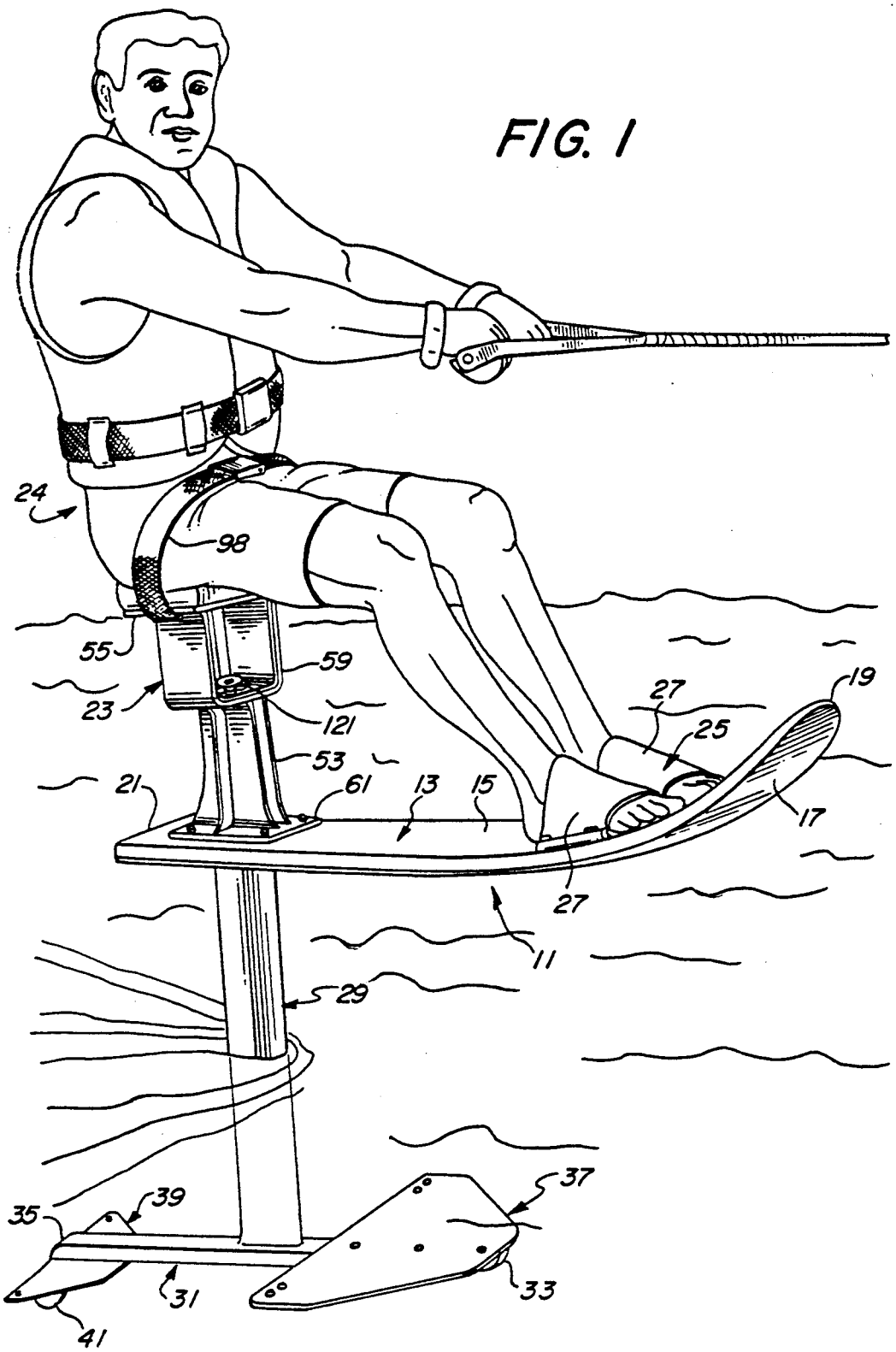
FIG. 1 is a perspective view illustrating a seated human rider being towed behind a powered watercraft (not shown)
Figures 2, 3, 4:
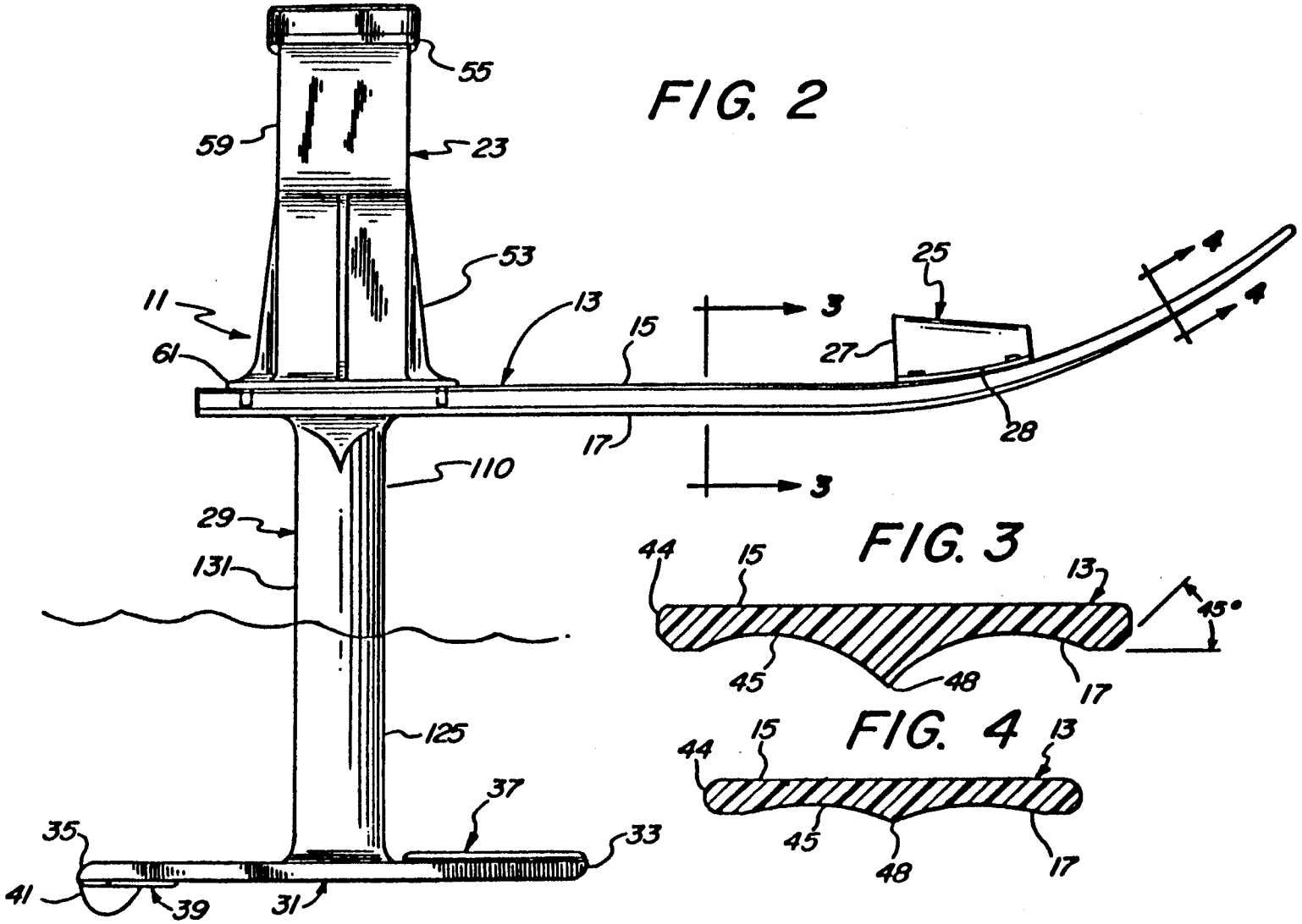
FIG. 2 is a side elevation view of the water sports device of FIG. 1 in a horizontal position.
FIG. 3 is a sectional view of the cross section of the board taken along 3—3 of FIG. 2.
FIG. 4 is a cross-sectional view of the board taken along 4—4 of FIG. 2.

Referring to FIGS. 1 and 2, there is shown a "flying ski" 11 which embodies the preferred design of the water sports device present invention. The flying ski 11 includes an elongate board 13 having an upper face 15 and a lower face 17, and a front end 19 and a back end 21. A seat 23 extends generally perpendicular to and upward from the upper face 15 of the board for supporting the buttocks of a seated rider 24 at a point spaced above the back of the board. The rider's legs extend forward toward the front of the board, where they are secured by a holder 25, such as a pair of rubber sheets 27, which are clamped to the front end 19 of the board by three clamping plates 28, best seen in FIG. 5, so as to form two elongate generally semi-circular loops into which the feet of the rider can be inserted. An elongate strut 29 extends generally perpendicular to and downward from the lower face 17 of the board 13. An elongate support 31 having a forward end 33 and rearward end 35 is fixed to the bottom end of the strut 29 at a point just forward of the middle of the support 31. A forward planing blade 37 is secured to the top of the forward end 33 of the support 31 so as to be generally parallel to the board 13. Likewise, a rear planing blade 39 is secured to the bottom of the rearward end 35 of the support 31 generally parallel to the board 13. A pair of vertical fins 41, 43 are secured to the bottom of the rear planing blade 39 on either side of the support 31. As will be discussed in greater detail below, it is important aspect of the present invention that the planing blade structure (i.e., the strut 29, the support 31, the forward planing blade 37, the rear planing blade 39 and the vertical fins 41, 43) provide essentially no lift when the board 13 is horizontal, as shown in FIG. 2.

The flying ski 11 and rider are desirably towed behind a standard powered water craft utilizing a standard ski tow rope, the handle of which is held by the rider (as illustrated in FIG. 1) at a point spaced roughly above the knees of the rider.

Figure 5:
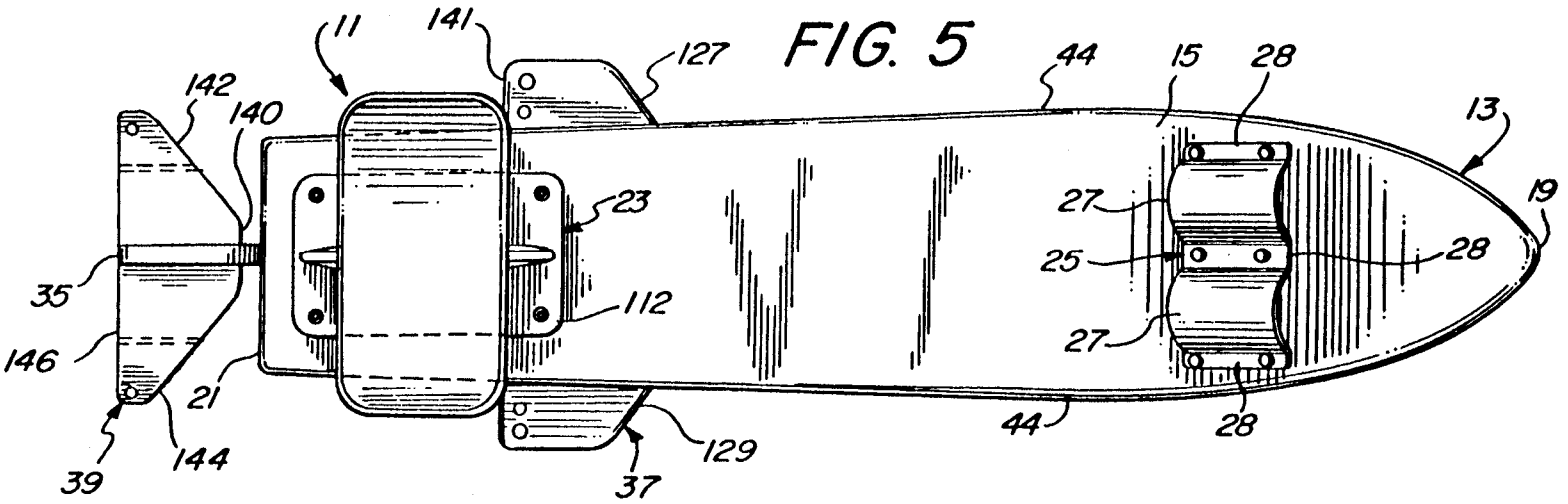
FIG. 5 is a top plan view of the water sports device of FIG. 1.

The various components of the flying ski 11 will now be described in greater detail. When looking at the ski from the top (as shown in FIG. 5),, the board 13 is generally bullet shaped, being symmetrically about its elongate axis and having a pair of generally straight sides 44 which taper towards one another at the front end 19, eventually coming to a rounded point. The back end 21 is squared-off, forming a pair of 90° corners. In the preferred embodiment the board has a length of 52 inches. When looking from the board 13 from the side (as shown in FIG. 2), the front end 19 of the board 13 is curved upward. Although an upwardly curved front end is common for skis, to assist the ski in moving over the surface of the water despite waves or other turbulence, this curve is more severe in the flying ski, the reason for which will be discussed below. Specifically, the front end of the board is 12 ½ inches above the back end of the board. The body of the board 13, that is the portion of the board 13 beginning just toward the back end 21 of the board 13 from the foot holders, is designed for increased strength. As best seen in FIG. 3, along the body of the board 13, the upper face 15 of the board 13 is flat, but the lower face 17 of the board 13 includes a pair of deep side concave portions 45, 47 which define a deep central drop keel 48. The increased thickness of the board at the keel significantly increases the strength of the board 13 and the combined hydrodynamic effect of the keel and the concave portions significantly enhance the skis' directional stability. The directional stability of the ski is further enhanced by a pair of 45° bevels 49, 51 which extend along the lower face 17 of the body of the board 13 along its sides. As best seen in FIG. 4, near the front end 19 of the board 13 the upper face of the board 13 is flat and the concave portions are much less pronounced. At the front of the board, the top and lower faces are joined by rounded sides. The board 13 can be made of wood or fiberglass composite, as well as other materials readily apparent to those of ordinary skill in the art.

Figure 7:
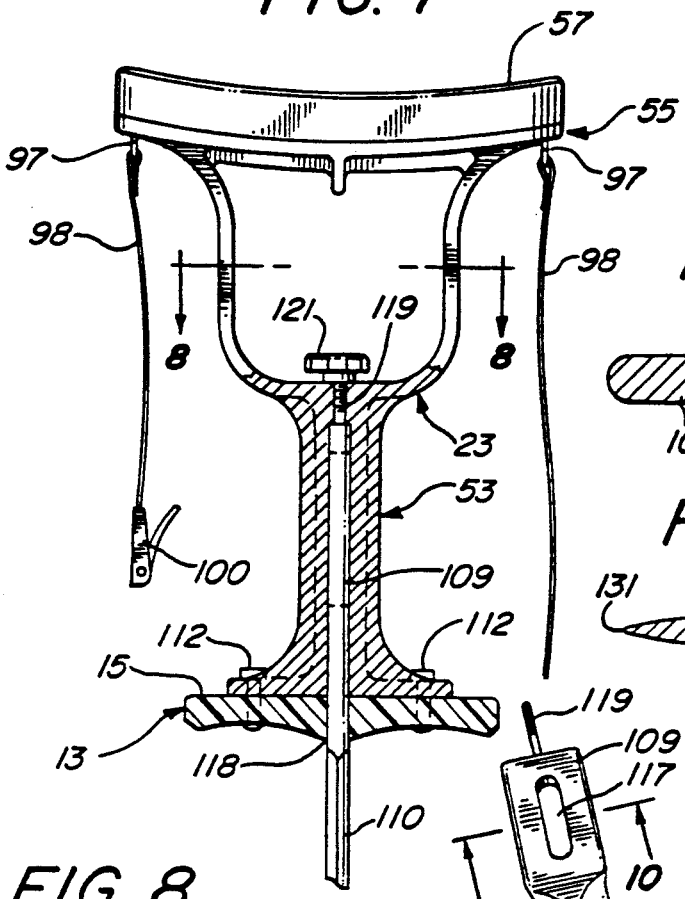
FIG. 7 is an enlarged partial sectional view illustrating the mating of the strut and seat of the water sports device of FIG. 1.
Figure 10:
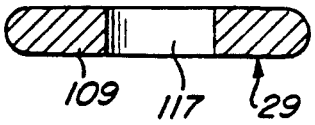
FIG. 10 is an enlarged sectional view of the strut taken along line 10—10 of FIG. 9.
Figure 8:
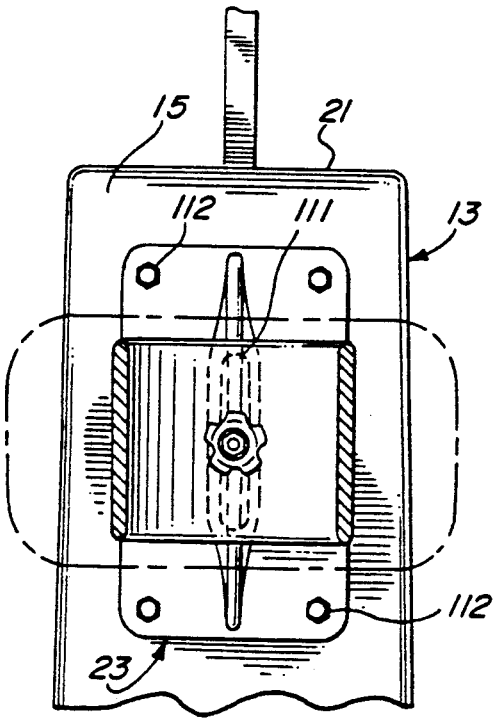
FIG. 8 is a top sectional view of the seat of FIG. 1.
Figure 9:
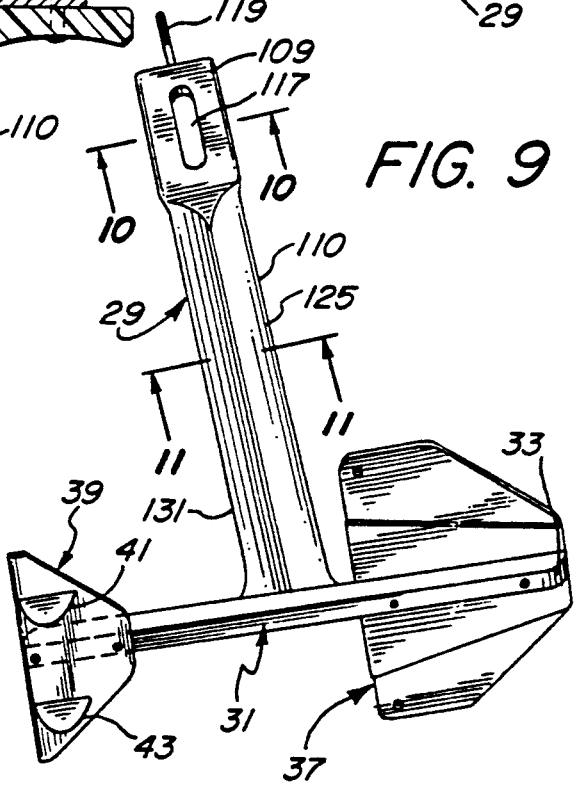
FIG. 9 is an enlarged perspective view of the planing blade structure of the water sports device of FIG. 1.

Referring now to FIGS. 1 and 2, the seat 23 includes a base portion 53 which is connected to the board 13, a platform portion 55 to which is secured a cushion 57 for supporting the buttocks of a rider, and a connecting portion 59 which connects the platform portion 55 and the base portion 53. Referring now to FIGS. 7 and 8, the base portion 53 includes a generally rectangular base plate 61 which is secured to the upper face 15 of the board 13 at a point centered roughly above the back one-eighth of the board 13. The positioning of the seat 23 relative to the back end 21 of the board 13 is an important aspect of the invention, the significance of which will be discussed below. The seat can be made of wood or metal, but is preferably made of rigid plastic due to the plastic's strength and light weight. Although it will be apparent to one of ordinary skill in the art that the base portion 53, platform portion 55 and connecting portion 59 could be of unitary construction, it has been found to be advantageous from a cost standpoint to mold these portions of the seat 23 from plastic in two halves.

Figure 12:
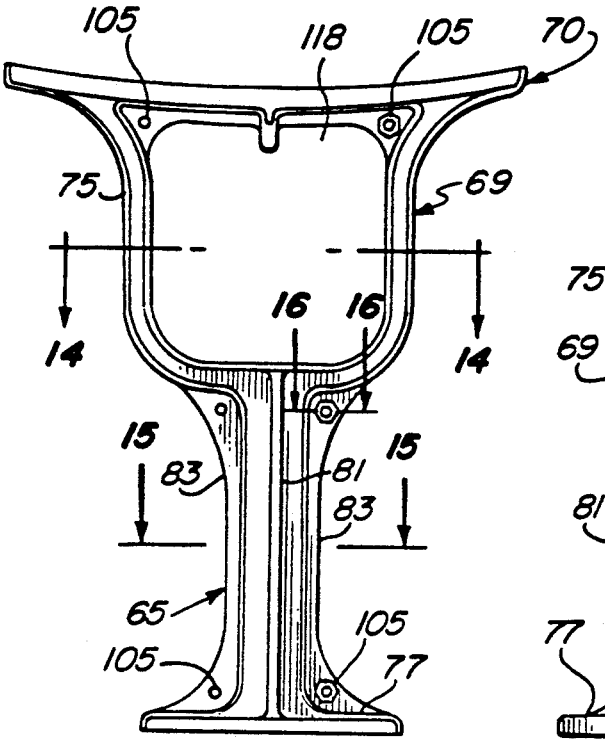
FIG. 12 is an elevation view of a half seat for the water sports device of FIG. 1.
Figure 13:
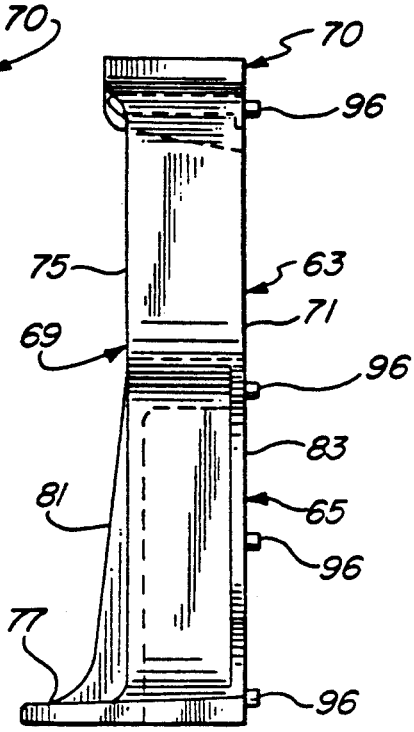
FIG. 13 is a side elevation view of the half seat of FIG. 12.
Figure 15:
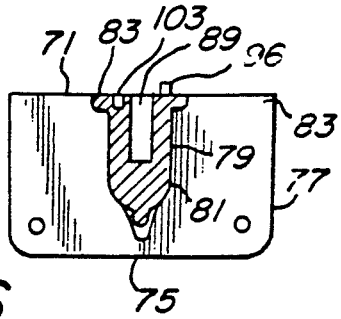
FIG. 15 is a top sectional view taken along line 15—15 of FIG. 12.
Figure 16:
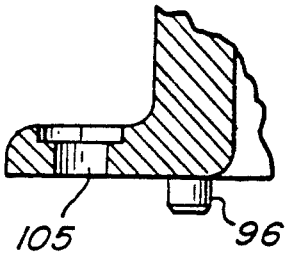
FIG. 16 in an enlarged partial sectional view illustrating the pins and apertures of the half seat of FIG. 12.

Referring now to FIGS. 12 and 13, a molded half seat 63 includes a half base portion 65, a half connecting portion 69 and a half platform portion 70. Referring to FIG. 13, the half seat has a mating end 71 which mates with a corresponding mating and of another half seat and an exterior end 75. As best seen in FIGS. 13 and 15, the base portion 53 of the seat 23 includes a generally rectangular half base plate 77 having rounded corners at its exterior end 75 and 90° corners at its mating and 71. A vertical column 79 centered between the sides of the base plate 61 extends upward from the mating end 71 of the base plate 61 to the connecting portion 59 of the seat 23. The column includes a primary flange 81 which extends perpendicular to the mating end 71 of the base portion 53 toward the exterior end 75, and a pair of side flanges 83, parallel to the mating end 71 of the base plate 61. As best seen in FIG. 12,, the side flanges 83 taper inward and upward from the half base plate 77 up the length of the vertical column 79 and then taper outward and upward until they join the half connecting portion 69.

Figure 14:
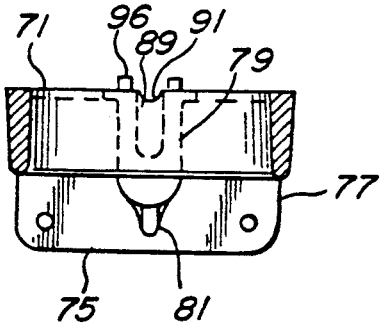
FIG. 14 is a sectional view of the half seat of FIG. 12 taken along line 14—14.

The half connecting portion 69 is generally U-shaped and forms a large generally rectangular opening 118 with the half platform portion 55. At the top of the U-shaped half connecting portion 69 is the horizontal half platform portion 70, which is bowed slightly downward in the middle to center the rider, and to provide a more comfortable and stable support surface. As best seen in FIGS. 14 and 15, a generally rectangular half channel 89 extends upward through the half base plate 95 and the vertical column 79 of the half portion 65 of the seat 23, to the half connecting portion 69. As best seen in FIG. 14 , a generally U-shaped half bore 91 in the middle of the U-shaped half connecting portion 69 extends from the half channel 89 through the top of the half connecting portion 69.

Advantageously, the two half seats can be secured to one another by means of a series of pins 96, which are integrally molded with the half seat, adapted to mate with a series of mating cavities 103 in the mating half seat, and by means of a series of nuts and bolts (not shown) which are secured through aligned apertures 105 in the side flanges 83 of each half portion 65 and each half platform portion 55 of the half seats.

Referring now to FIG. 7 and 8, once the half seats have been assembled, the hard foam cushion 57 is secured to the top of the platform portion 55, to provide a more comfortable ride for the user. The platform portion 55, is approximately 15 inches above the upper face 15 of the board 13. Likewise, mating halves of a seat belt 98 can be secured to a loop 97 on either side of the seat 23, to firmly secure the rider to the seat 23. The outer end of one of the seat belt halves 98 is provided with a clamp 100 for locking the seat belt halves snugly about the hips of the rider once the tightness of the seat belt has been appropriately adjusted.

Referring now to FIGS. 2 and 9–11, the strut 29 of the planing blade structure includes a tongue section 109 at its top end and a lower section 110 extending from the tongue section 109 to the bottom end of the strut 29. The tongue section 109 of the strut 29 is adapted to be slidably received by a channel 111 formed by the horizontally aligned half channels 89 when the half seats 63 are connected and the base plate 23 of the seat is secured to the upper face 15 of the board 13 by a series of fasteners 112, such as nuts and bolts. As will be appreciated, the board 13 includes an opening 118 centered between the sides of the board, preferably, corresponding in size and shape to the channel 111, for receiving the tongue portion 110 of the strut 29. Advantageously, the tongue portion includes an oblong aperture 117, sized and shaped to receive the four fingers of a rider so that the planing blade structure can be conveniently carried and/or lifted from the water after use. Furthermore, at the top of the strut 29 is advantageously fixed a threaded shaft 119 adapted to be inserted within the bore formed by the horizontally aligned half bores 91 when the half seats are connected. The bore extends from the channel 111 of the base portion 53 of the seat 23 to the rectangular opening 118 in the middle of the connecting portion 59 of the seat 23. Upon the full insertion of the tongue portion 109 of the seat 23 into the channel 111 (i.e., insertion until the top of the strut 29 abuts the top end of the channel 111). the threaded shaft 119 will extend through the bore, enabling the strut 29 to be quickly and easily secured in place by means of a threaded hand knob 121.

Figure 11:
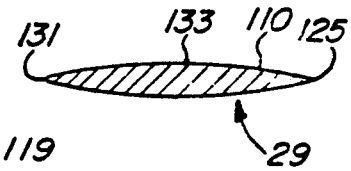
FIG. 11 is an enlarged sectional view of the cross section of the strut taken along line 11—11 of FIG. 9.

Upon the full insertion of the tongue portion 109 of the strut 29 into the channel 111, as shown in FIG. 2, only the lower section 110 of the strut 29 will be exposed. The lower section 110 of the strut is desirably at least 24 inches in length and preferably, as in the preferred embodiment, 29 inches in length, the significance of which will be discussed below. As shown in FIG. 11, the strut 29 has an elongate, generally bi-convex-shaped cross section, symmetrical about its elongate axis, with a single narrow leading edge 125 and a single narrow trailing edge 131, with a thicker middle portion 133 for strength. The elongate axis of the cross section of the strut and the opening in the board are parallel to the elongate axis of the board.

The elongate support 31 is symmetrical about its elongate axis and is fixed to the bottom end of the strut 29 so as to extend forward and rearward from the strut 29 so that its elongate axis is parallel to the elongate axis of the cross section of the strut and the elongate axis of the board. Preferably, due to the extreme stress placed upon the junction between the strut 29 and the support 31, the strut 29 and support 31 are formed as a single unit. Specifically, to provide the optimum strength and weight characteristics, it has been found to be preferable to utilize a single, generally T-shaped arm of cast A-356 aluminum alloy heat treated to T-6 for the strut 29 and support 31.

Figure 6:
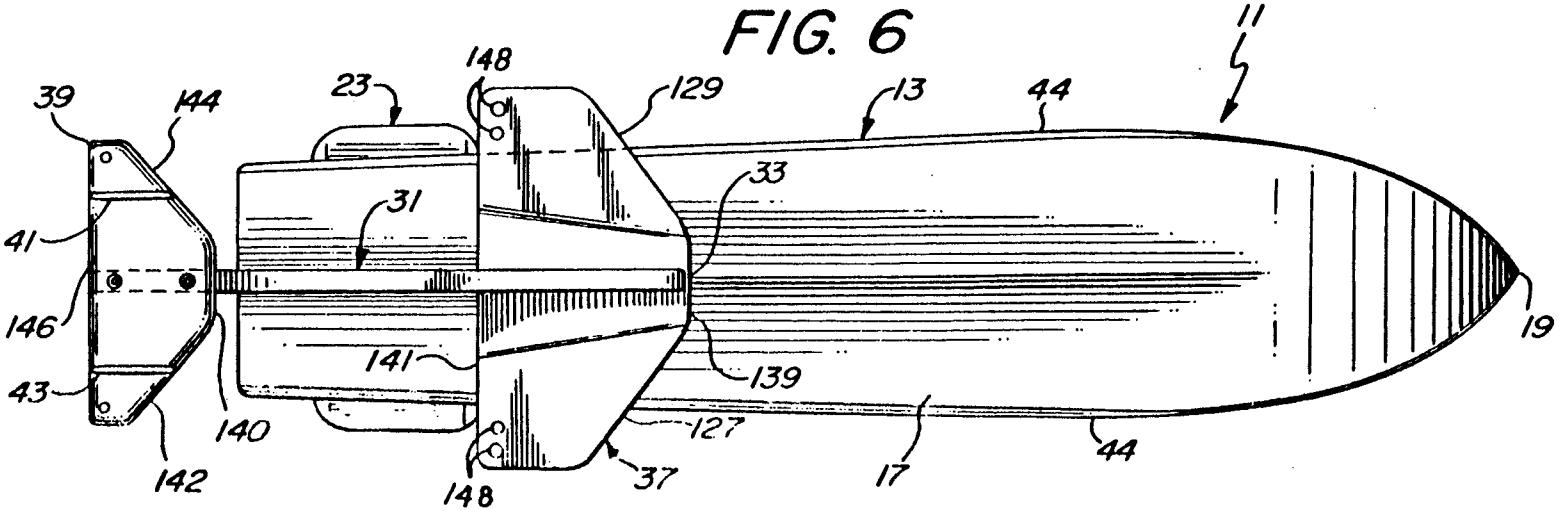
FIG. 6 is a bottom plan view of the water sports device of FIG. 1.

Referring now to FIGS. 5 and 6, the forward planing blade 37 is formed by a rigid, generally flat plate having a shape generally resembling a triangle truncated at each of the corners. Specifically, the front planing blade has a front leading edge 139 perpendicular to the support 31 and a pair of side leading edges 127, 129 which taper outwards and backwards from the front edge at an angle of approximately 45°, until they extend sideways 3 inches beyond the sides 44 of the board 13, at which point they extend rearward roughly parallel to the sides of the board 13 before terminating in a trailing edge 141 which is parallel to the front leading edge 139 of the planing blade, perpendicular to the support 31. The blades are preferably made of one quarter inch thick aluminum plates. Desirably, however, the middle of the front planing blade 37, where the blade 37 is secured to the strut, is thicker than the sides of the blade 37, for increased strength. In the preferred embodiment, the middle of the front planing blade 37 has a thickness of three-eighths of an inch, with the upper face of the planing blade being flat and the bottom face of the planing blade tapering upward from the middle. Desirably, the rear planing blade 39 is substantially smaller than the front planing blade, but has a virtually identical shape, with a front leading edge 140 perpendicular to the strut 29, outwardly and rearwardly tapering side leading edges 142, 144 extending 2 ½ inches beyond the sides of the board, sides parallel to the support 31 and a trailing edge 146 which is perpendicular to the support 31. The planing blades preferably are mounted so as to be symmetrical about the elongate axis of the support. Advantageously, a plurality of holes 148 (FIG. 1) is positioned along the corners of trailing edges of the planing blades. In the preferred embodiment there are two holes in each corner adjacent the trailing edge of the front planing blade and one hole in each corner adjacent the trailing edge of the rear planing blade. This has been found to eliminate harmonic vibration caused by the metal running through the water.

The vertical stabilizing fins extend vertically downward from either side of the bottom of the rear planing blade 39 on either side of the support 31, approximately midway between the support 31 and the side of the planing blade.

OPERATION

The operation of the water flying ski 11 and the significance of the unique structural relationships of the flying ski 11 will now be described.

For ease of handling during transportation between storage and the tow boat, the flying ski 11 is conveniently stored in two pieces, with the seat 23 and foot holders permanently affixed to the board 13, and the planing blade structure sitting separately with the hand knob 121 loosely threaded on the planing blade structure to prevent it from being lost. The entire unit may be easily carried by an adult by means of grasping the board 13 and seat 23 under one arm, and by inserting the fingers of the hand of the arm through the aperture of the strut 29 and holding the planning blade structure to the opposite side.

Once in the tow boat or near the water's edge, it is a simple matter to insert the tongue section 109 of the strut 29 through the aperture in the board 13, so that the tongue section 109 is received by the channel 111 of the seat 23, and quickly securing the strut 29 in place by means of tightening the threaded hand knob 121 over the exposed threaded shaft 119 at the base of the connecting portion 59 of the seat 23. Thus assembled, the rider then places the flying ski 11 in the water, straps the seat belt over the tops of his or her thighs and inserts his or her feet into the foot holders.

The rider then grasps the handle of the tow rope. At this point, due to the weighting of the device, the front end 19 of the board 13 will have a tendency to angle upward, which in the desired position for starting. As the ski boat accelerates from a stop, the deep keel 48 of the flying ski 11 gives the ski directional stability, largely eliminating any tendency of the ski to veer to the left or right before sufficient speed is gathered to raise the rider out of the water.

By inclining the board 13 backward, the rider is able to not only use the board 13 as a planing surface, but to use the force of the water on the lower surface of the large planing blades to easily lift the board 13 above the surface of the water so that the only portion of the flying ski 11 in the water is the planing blade structure. However, in sharp contrast to the device of the prior art, which utilized hydrofoil surfaces, the planing blades are parallel to the board 13 so that the inclination of the rider, rather than the speed of the boat determines the height the rider will rise out of the water. Likewise, contrary to hydrofoils, in which the rider is essentially supported by only a thin strip of the trailing edge 141 of the hydrofoil, the entire lower surface area of the planing blades is generally supported by the water, thus providing a much larger effective supporting surface area, thereby greatly increasing the ability of the rider to maintain his or her balance, while riding. Also, the positioning of the blades to the front and rear of the strut greatly facilitates the rider maintaining his or her balance from front to back. Furthermore, the solid seating position of the rider and the relatively wide foundation provided by the relatively wide planing blades enhances side-to-side stability.

Another important aspect of the invention is that the strut 29 is designed to effectively eliminate its contribution to the lifting force on the flying ski 11. Specifically, when the strut 29 is in an upright position, the configuration of the strut 29 is such that there is no lifting force generated by the strut 29 at all. As a result, the rider need not worry about compensating for changes in lift as he or she cuts back and forth across the wake of the tow boat. Likewise, the single strut 29 configuration and the design of the strut 29 itself, effectively eliminates the creation of vortices which made the prior art devices so difficult to control.

Nonetheless, even with the planing blade structure utilized, the flying ski 11 is still sensitive to changes in angle of attack (i.e., the angle of the planing blades relative to the horizontal axis) resulting from the inclination of the board 13. Thus, another significant aspect of the invention is the positioning of the rider's feet a significant distance forward of the seat 23. Naturally, this is important from the standpoint of comfort, in that this sitting position is vastly more comfortable than kneeling, particularly when one takes advantage of the flying ski's 11 jumping ability, as described below. More importantly, however, the spacing of the feet of the rider from the point of stability (i.e., the hips of the rider) enables the rider to lean back and lift the front of the board to use the board 13 as a lever to change the angle of attack of the planing blades. Obviously, this minimizes the strength required to control the flying ski 11, but more importantly it decreases the sensitivity of the flying ski 11 to movement. That is, although the effective force applied by the feet of the rider to the flying ski 11 need not be as great due to the use of the lever action, the effective distance the feet of the rider must move to accomplish the same change in angle of the planing blades is substantially increased. In this regard, it has been found that the feet holders should be mounted at least two feet, desirably at least two and one-half feet, and preferably three feet, in front of the seat.

It is highly desirable that the foot holders secure both feet to the board to improve the rider's control. It is also highly desirable that the foot holders be mounted side by side, rather than in front of one another, to provide a wide base. This wide base significantly increases the rider's side to side stability. In the preferred embodiment the board has a width of twelve inches allowing for a relatively wide base.

Another significant advantage of the present invention is the seat belt. The seat belt is very desirable for the rider in that experience has shown that the primary safety risk to a rider of the flying ski 11 in becoming separated from the ski and being struck by the ski at a high rate of speed. By securing the buttocks of the rider firmly to the seat 23, with feet of the rider secured firmly within the foot holders, the rider and flying ski 11 will roll or tumble as one, eliminating the danger of major impact. Another key function of the seat belt is to maintain the rider in the correct position on the seat 23. That is, it has been found that it is highly desirable to have the front of the hips of the rider centered directly above the seat 23 to insure the proper weight distribution for optimum maneuverability. This is particularly true when jumping. It has been found that without the seat belt the rider's position relative the seat tends to move causing the rider's weight to be distributed improperly upon impact, often causing a fall.

Finally, by securing the rider firmly to the seat 23, it greatly enhances the rider's feel for the ski and ability to maneuver. The creation of the point of stability is the combined result of a number of factors, including the unique structural relationships of the board 13, the seat 23 and the planing blade structure, as well as the position in which the rider holds the tow rope. Through the use of the seat belt, the rider not only has a point from which to operate the fulcrum, but the rider actually feels part of the ski.

In addition to enabling the rider to experience the thrill of maneuvering back and forth substantially above the surface of the water, the flying ski 11 design is also particularly adapted to enable the rider to perform exceptional jumps. Specifically, by abruptly leaning backward, a rider can easily launch bin or herself and the flying ski six or eight feet into the air. Although prior art devices may have resulted in the rider flying out of the water, the present design particularly constructed to make the experience enjoyable, rather than a prelude to an undesired tumble. Specifically, the size of the planing blades is such that the effect of the planing blades striking the water substantially breaks the rider's descent and, by landing with the board 13 inclined backward at an angle, the lifting forces generated on the planing blades by the water can counteract the force of gravity, preventing the lower face 17 of the board 13 from even striking the water. Due to the height of the jumps possible with the flying ski 11, this is particularly desirable. For this reason, the positioning of the seat 23 and the planing blade structure is particularly important.

It has been found to be important for the rear planing blade 39 to be positioned below the board 13 at least as far back as the back one-quarter of the board 13, desirably below and at least as far back as the back one-eighth of the board 13, and preferably, as in the preferred embodiment, positioned behind the back end of the board 13. This enables the rider, by inclining the board 13 back at an angle, to use the resistance of the water on the lower surface of the planing blades and the lifting forces generated by the movement of the inclined planing blades through the water, to break his or her landing. Generally, the further forward the rear planing blade 39, the greater the likelihood that the back end 21 of the board 13 will strike the water before the planing blades can break the landing, resulting in a substantially increased impact on the rider. Likewise, it in desirable that the blades are spaced by the strut at least 24 inches below the board, to allow the planing blades to break the rider's landing before the board strikes the water.

In this regard, it has been found that it is not only the position of the planing blades, but also their size which breaks the impact of the landing. Specifically, it is preferable for the rear planing blade to have a lower surface area of 46 square inches, and for the forward planing blades 37 to have a lower surface area of 117 square inches. Desirably, the front and rear planing blades 39 have a total surface area of at least 100 square inches.

In addition, it has been found that it is important for the seat 23 to be centered over the back third of the board 13, and desirably on the back quarter of the board 13, and preferably,, as in the preferred embodiment, over the back one-eighth of the board 13. Unless the seat 23 is positioned in this manner, when planing blades strike the water upon landing, it will tend to throw the rider forward, changing the attack angle of the planing blades and causing the rider to lose his or her balance. Furthermore,, if the seat 23 is otherwise positioned, when the back end 21 of the board 13 strikes the water, the rider will likewise be thrown forward.

Another aspect of the present invention is the vertical alignment of the unique planing blade structure of the present invention with the seat. The tongue portion of the strut strengthens the seat and the base portion of the seat surrounding the channel prevents the strut from moving from a perpendicular position relative the board.

After gaining some expertise on the flying ski 11, it is possible for riders to jump the flying ski 11 over 15 feet in the air. Even with the breaking force of the planing blades and the lifting action they create after they strike the water, the landing will still generate considerable stress on the board. The deep keel of the board 13 gives the, board 13 sufficient strength withstand this stress and to dissipate the force over the length of the board 13. Likewise, the deep keel overcomes any tendency of the board 13 to trip to the right or left upon landing and holds the ski in a straight line. Furthermore, the accentuated curve of the front end of the ski creates a "rocker," so that if the rider lands at the wrong angle of attack, the curved bottom face of the board will tend to "rock" the front end of the flying ski upward, correcting the angle of attack so that the movement of the planing blades through the water again lifts the rider upward.

After the run is completed, the rider simply releases the seat belt and loosens the hand knob releasing the tongue portion of the strut from the channel. The rider inserts his or her hand through the aperture in the tongue portion of the strut and hands the planing blade structure and then the board to the watcher in the tow boat.

Thus, there is provided an improved water sports device which is both easy and exciting to ride, and which minimizes the stress and strain on the rider's legs and lower back, inherent by riding traditional water skis.

We claim:

1. A water sports device for supporting a seated human rider while said rider and said device are towed behind a powered watercraft, comprising:

an elongate board having a front end and a back end;

a seat secured to said board for supporting the buttocks of a seated rider at a position spaced above the back of the board;

an elongate arm extending downward from said board;

a fixed planing blade secured to said arm, said planing blade having a leading edge, wherein said planing blade is spaced from and generally parallel to said board and has an angle of attack with respect to the surface of the water when towed behind a watercraft; and a holder spaced toward the front end of said board from said seat for securing at least one foot of said rider over said board, wherein said holder is positioned forward of said leading edge of said planing blade to facilitate said rider using said at least one foot to change the angle of attack of said planing blade by using said board as a lever.

2. The water sports device of claim 1, further comprising a seat belt for securing the buttocks of said rider to said seat to protect said rider from being struck by said device in the event of a fall.

3. The water sports device of claim 2, wherein said planing blade is positioned below said board at least as far back as the back one-quarter of said board.

4. The water sports device of claim 1, wherein said planing blade extends behind the back end of said board.

5. The water sports device of claim 1, wherein said blade defines a plurality of holes at one of its outer extremities for minimizing harmonic vibration.

6. The water sports device of claim 1, wherein said seat includes a platform spaced approximately 15 inches above said board.

7. A water sports device for supporting a seated human rider while said rider and said device are towed behind a power watercraft, comprising:

an elongate board having a front end and a back end;

a seat secured to said board for supporting the buttocks of a seated rider at a position spaced from and roughly centered above the back portion of said board;

a holder spaced toward the front end of said board from said seat for securing at least one foot of said rider over said board;

an elongate arm extending downward from said board, wherein said elongate arm is positioned at a location generally centered below the back portion of said board and said seat is positioned above said arm;

a planing blade secured to said arm, whereby, in use, the weight of the rider is supported entirely by said arm when said board is raised out of the water.

8. The water sports device of claim 7, further comprising a seat belt for securing the buttocks of said rider to said seat to protect said rider from being struck by said device in the event of a fall.

9. The water sports device of claim 7 wherein said seat is secured to said board above the back one-third of said board.

10. The water sports device of claim 9 wherein said holder spaced at least two feet toward the front end of said board from said seat.

11. The water sports device of claim 10, further comprising a seat belt for securing the buttocks of said rider to said seat to protect said rider from being struck by said device in the event of a fall.

12. The water sports device of claim 7, wherein said seat includes a platform spaced at least fifteen inches above the upper surface of said board.

13. A method for a human rider to jump out of the water on a water sports device while said device is towed behind a powered watercraft, said device including a member having a front end and a back end, a seat secured to said member and a blade generally parallel and fixed below said member, said blade having an angle of attack with respect to the surface of the water when towed behind a watercraft said method comprising:

positioning the buttocks of said rider in said seat;

securing at least one foot of said rider to said member toward the front end of said member from said seat forward of said planing blade; and leaning backward, and thus lifting said at least one foot and, thus said front end of said member and said planing blade to change said angle of attack of said blade, causing said member and said rider to jump out of said water.

14. The method of claim 13, wherein said member comprises a board.

* * * * *